US007500434B2

(12) United States Patent
Flatau et al.

(10) Patent No.: US 7,500,434 B2
(45) Date of Patent: Mar. 10, 2009

(54) RING AIRFOIL STYLE PAINTBALL AND LAUNCHER

(76) Inventors: Abraham Flatau, 3330 Vernon Ter., Palo Alto, CA (US) 94303; Chester F. Vanek, 1171 Redrock Ct., Sunnyvale, CA (US) 94089

( * ) Notice: Subject to any disclaimer, the term of this patent is extended or adjusted under 35 U.S.C. 154(b) by 0 days.

(21) Appl. No.: 11/271,052

(22) Filed: Nov. 9, 2005

(65) Prior Publication Data

US 2006/0096492 A1 May 11, 2006

Related U.S. Application Data

(63) Continuation of application No. 10/754,466, filed on Jan. 9, 2004, now abandoned.

(60) Provisional application No. 60/438,879, filed on Jan. 9, 2003.

(51) Int. Cl.
*F42B 14/06* (2006.01)

(52) U.S. Cl. ..... 102/503; 102/502

(58) Field of Classification Search ..... 102/503
See application file for complete search history.

(56) References Cited

U.S. PATENT DOCUMENTS 3,877,383 A 4/1975 Flatau et al.
3,888,178 A * 6/1975 Senoski ..... 102/348
3,898,932 A 8/1975 Flatau et al.
3,951,070 A 4/1976 Flatau et al.
3,980,023 A * 9/1976 Misevich ..... 102/502
3,982,489 A 9/1976 Flatau et al.
4,154,012 A 5/1979 Miller
4,190,476 A 2/1980 Flatau et al.
4,212,244 A 7/1980 Flatau et al.
4,262,597 A 4/1981 Olson
4,270,293 A 6/1981 Plumer et al.
6,386,113 B1 5/2002 Pinney
6,546,874 B2 4/2003 Vasal et al.
6,647,890 B2 * 11/2003 Findlay ..... 102/503
2001/0045173 A1 11/2001 Gibson et al.
2003/0000122 A1 1/2003 Vanek et al.
2003/0051719 A1 3/2003 Vanek et al.
2003/0097952 A1 5/2003 Findlay
2003/0234013 A1 12/2003 Hunter et al.
2005/0016049 A1 1/2005 Vanek et al.
2005/0066843 A1 * 3/2005 Flatau et al. ..... 102/503

* cited by examiner

*Primary Examiner*—Troy Chambers
(74) *Attorney, Agent, or Firm*—Weide & Miller, Ltd.

(57) ABSTRACT

A ring airfoil style paintball comprises a ring airfoil carrying a visible marking agent. The marking agent is located in one more compartments in a nose portion of a body of the ring airfoil, or within one or more containers located in those compartments. The nose portion of the body of the airfoil is configured to rupture upon impacting a target, releasing the marking agent into contact with the target. Cartridges comprising a sabot containing the ring airfoil style paintball are launched from a launcher. The launcher includes a magazine for sequentially delivering cartridges for launch. A stripper associated with the launcher strips the sabot from the ring airfoil paintball, and an ejector ejects the stripped sabot from the launcher.

7 Claims, 5 Drawing Sheets

RING AIRFOIL STYLE PAINTBALL AND LAUNCHER

RELATED APPLICATION

This application is a continuation of U.S. patent application Ser. No. 10/754,466, filed Jan. 9, 2004, now abandoned which claims priority to U.S. Provisional Patent Application Ser. No. 60/438,879, filed Jan, 9, 2003.

FIELD OF THE INVENTION

The present invention relates to a projectile for delivering a marking agent.

BACKGROUND OF THE INVENTION

The sport of paintball has experienced tremendous growth. In this sport, targets (generally opposing players) are marked with paint delivered by a "paintball." The present state of the art paintball is a three gram hollow spherical projectile, usually made of gelatin, and filled with a glycol based pigment. These paintballs are launched from compressed air or carbon dioxide powered devices at velocities not exceeding three hundred feet per second.

The present invention is directed at overcoming two major limitations of present, state of the art paintballs: short range and poor accuracy. These factors have limited the distance at which a paintball can be effectively launched. Thus, one desiring to mark an object must close to within the projectiles relatively short range, which is sometimes not possible and is always inconvenient. In current game play where players attempt to mark their opponents before they are themselves marked, these limitations devolve the game into a close-range shootout. Thus, the emphasis of the sport has been upon high rate of fire launching devices.

Several problems contribute to the short range and poor accuracy of the paintball. First, the short range is due in part to the limitation upon the maximum velocity of the paintball. For safety considerations, in the sport of paintball, the velocity can not exceed three hundred feet per second. Accuracy problems result from a number of factors. Paintballs may not be symmetrical and may not have a center of mass which coincides with the center of the ball. Both of these factors cause the paintball to spin, causing it to curve from a straight trajectory. This is especially the case at a higher velocities. Of course, if the paintball is launcher at a lower velocity, then the paintball's range is further decreased.

A solution to the above-stated problems is desired.

SUMMARY OF THE INVENTION

One embodiment of the invention comprises a ring airfoil style paintball. The ring airfoil style paintball comprises a ring airfoil carrying a marking agent.

The ring airfoil comprises a generally annular body defining a central passage. The body has a nose or forward section and a tail or rear section. The cross-sectional shape of the body is wing-shaped.

Marking agent is located in one more compartments of the body of the ring airfoil. In one embodiment, marking agent is located in an annular ring in a nose section of the body. In another embodiment, marking agent is located in a plurality of individual compartments in the nose section of the body. The individual compartments are preferably spherical in shape. The marking agent may be directed located in the compartments, or may be located in containers which are then located in the compartments.

In one embodiment, the ring airfoil style paintball is connected to a sabot for launching, the sabot protecting the ring airfoil style paintball during launching. Cartridges comprising a sabot containing the ring airfoil style paintball are launched from a launcher.

In one embodiment, the cartridges are launched with a compressed air charge. The launcher includes a trigger which releases a compressed air charged behind a loaded cartridge. The cartridge is then propelled through a barrel. A sabot stripper is located at the end of the barrel. The sabot stripper strips the sabot from the ring airfoil style paintball, allowing the ring airfoil style paintball to travel towards the intended target. Preferably, the stripped sabot is ejected from the launcher, clearing the path for the next cartridge.

In one embodiment, the launcher accommodates a magazine for sequentially delivering cartridges for launch. The magazine is configured to contain a plurality of cartridges and is re-loadable.

Preferably, a barrel of the launcher is rifled for imparting a spin to the sabot. This spin is, in turn, imparted to the ring airfoil style paintball, giving it gyroscopic stability during flight.

The ring airfoil style paintball is preferably configured to deliver the marking agent upon impacting a target. In one embodiment, the body is thus constructed to fragment, such as from a frangible polystyrene material. The marking agent is located at a nose portion of the body so that when the body ruptures, the marking agent is placed into direct contact with the target. Imprinting or impregnating of the target with marking agent is facilitated by transfer of inertial force of the body, including the tail portion, to the marking agent.

The ring airfoil style paintball of the invention has numerous benefits and advantages. Among others, the ring airfoil style paintball has a true flight path and travels farther than standard spherical paintballs when the same launch energy is imparted. This allows the ring airfoil paintball to be used in long-distance targeting. In addition, the lower launch energy and larger impact surface area greatly reduces the probability of injury associated with impact of the paintball at the target.

Further objects, features, and advantages of the present invention over the prior art will become apparent from the detailed description of the drawings which follows, when considered with the attached figures.

DETAILED DESCRIPTION OF THE INVENTION

The invention is a ring airfoil style paintball and a launcher therefor. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
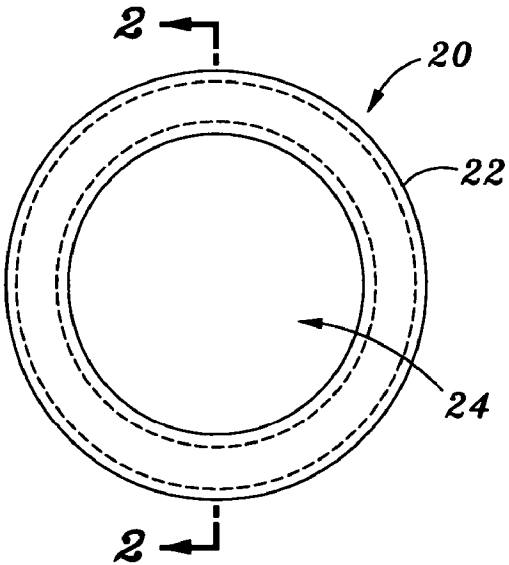
FIG. 1 is a front view of a ring airfoil style paintball in accordance with one embodiment of the invention.

FIG. 1 illustrates a ring airfoil style paintball 20 in accordance with one embodiment of the invention. As illustrated, the ring airfoil style paintball 20 has a ring airfoil shape. In particular, the paintball 20 has a body 22 which is generally annular, thus defining a central passage 24 leading from a nose 26 to a tail 28. As illustrated, the nose 26 comprises a generally forward section of the body 22, while the tail 28 comprises a generally rear section of the body 22, when considering the direction of flight of the ring airfoil style paintball 20.

Figure 2:
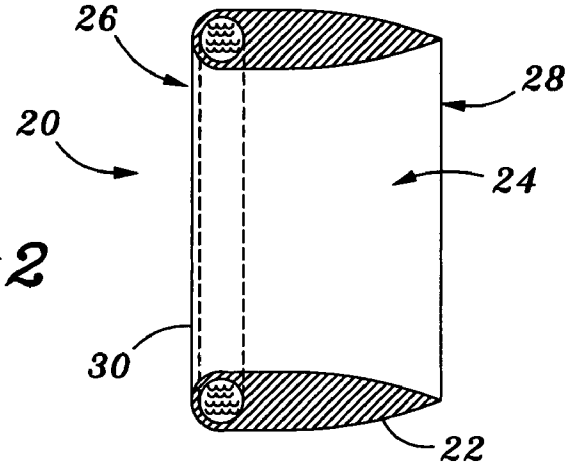
FIG. 2 is a cross-sectional view of the ring airfoil style paintball of FIG. 1 taken along line 2-2 therein.

Referring to FIG. 2, as illustrated, the thickness of the body 24 decreases from the nose 26 to the tail 28, contributing to a "wing" cross-sectional shape. The particular shape of the body 24 may depend upon a variety of factors, primarily associated with the desired aerodynamic characteristics of the airfoil.

As indicated, the paintball 20 is preferably configured to deliver a payload. This payload preferably comprises marker or marking agent such as the visible, glycol based pigment delivered by standard paintballs. Thus, the ring airfoil style paintball 20 preferably includes at least one compartment configured to contain marker or marking agent, or another container containing such agent.

Referring to FIG. 2, in one embodiment a cavity or compartment comprising an annular tube 30 is located in the body 22 of the paintball. Preferably, the annular tube 30 is located at the nose 26 section of the body 22. The tube 30 preferably comprises a hollow cavity within the body. The tube 30 is preferably filled partly or completely with a marking agent before the paintball 20 is utilized. Because the cavity within the body 22 is enclosed by the body, the material forming the body contains the marking agent.

Figure 4:
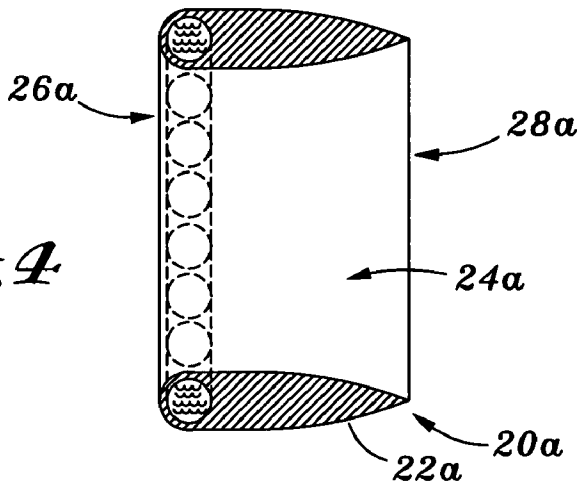
FIG. 4 is a cross-sectional view of the ring airfoil style paintball of FIG. 3 taken along line 4-4 therein.
Figure 3:
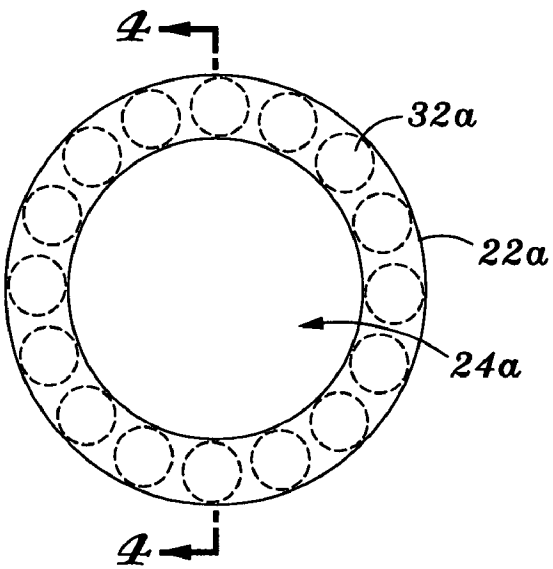
FIG. 3 is a front view of a ring airfoil style paintball in accordance with a second embodiment of the invention.

FIGS. 3 and 4 illustrate another embodiment ring airfoil style paintball 20*a* in accordance with the invention. In the description and figures, an "a" designator has been added to the reference numerals designating this embodiment, it being understood that like reference numerals refer to like parts to the ring airfoil style paintball 20 described above and illustrated in FIGS. 1 and 2.

This embodiment paintball 20*a* is similar to the previous embodiment, the paintball 20*a* comprising a body 22*a* having nose 26*a* and tail 28*a* and defining a central passage 24*a*. In this embodiment, the paintball 20*a* includes a plurality of cavities or compartments 32*a*.

As illustrated, the compartments 32*a* are generally spherical in shape. The compartments 32*a* are preferably located in the nose 26*a* of the body 22*a*. In order to balance the ring airfoil style paintball 20*a*, the compartments 32*a* are preferably symmetrically located or arranged in the body about a centerline passing through the passage 24*a* through the body 22*a*. One or more of the compartments 32*a* are filled with marking agent before the paintball is utilized.

In the embodiments illustrated in FIGS. 2 and 4, the body of the ring airfoil style paintball 20, 20*a* defines a space which directly contains marking agent. In other embodiments, referring to FIGS. 5 and 6, marking agent is housed or located within one or more containers, and those one or more containers are then located in the body.

Figure 6:
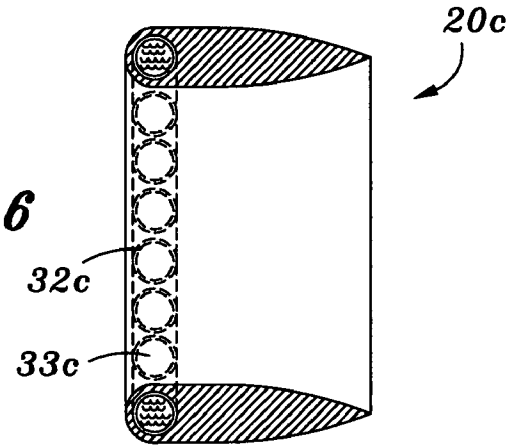
FIG. 6 is a cross-sectional side view of a fourth ring airfoil style paintball in accordance with the invention.
Figure 5:
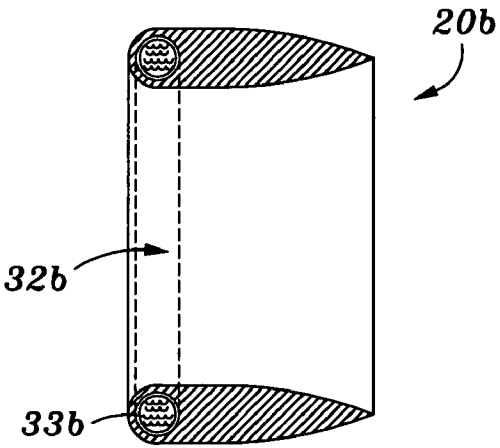
FIG. 5 is a cross-sectional side view of a third ring airfoil style paintball in accordance with the invention.

Referring to FIG. 5, a tube-shaped container 33*b* may be configured to be located in the body 22*b*, such as within a tube-shaped cavity or compartment 32*b* defined by the body. Referring to FIG. 6, generally spherical containers 33*b* may be configured to be located in the body 22*c*, such as in one or more generally spherical compartments 32*c* defined by the body. In these embodiment, the marking agent containers 33*b*, 33*c* contain marking agent, and those containers are carried within the body 22*b*, 22*c*. The marking agent containers 33*b*, 33*c* maybe associated with the body in various manners, such as by being formed into or located within the body during the manufacturing process.

As described below, in use, the marking agent is preferably released from the body into direct contact with a target. Accordingly, the airfoil 20 is configured: (1) so the marking agent will be released when the body 22 impacts a target and (2) so, when the marking agent is released, it is released into direct contact with the target.

In order to facilitate the release of marking agent, the body 22 is configured to rupture or break apart when it impacts a target. In a preferred embodiment, the body 22 is a dense, frangible, molded polystyrene foam which will break or rupture upon impact with a target. The body 22 may be provided with stress risers to concentrate impact forces to cause the body 22 to break into pieces or rupture. For example, the body 22 may have a plurality of designed areas of lower structural integrity and/or force concentrating areas which, when the body 22 impacts, cause the body 22 or at least a portion thereof, to break apart.

Figure 12:
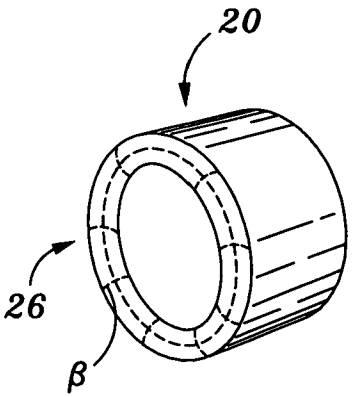
FIG. 12 illustrates a nose portion of a ring airfoil style paintball of the invention including stress risers facilitating rupture thereof.

In a preferred embodiment, as illustrated, the marking agent is covered or contained by a relatively thin layer of material forming the body and/or the container wall at the very front of the airfoil at the nose portion. When the body 22 impacts a target, the thin layer(s) of material easily ruptures, releasing the marking agent. As described above, the material may be formed with one or more stress risers to facilitate rupture. For example, in one embodiment, as illustrated in FIG. 12, the "covering" material at the nose portion of the body 22 may be perforated P or otherwise be configured with one or more points of weakness in order to facilitate the breaking or rupturing, and thus release of the marking agent. As illustrated, material comprising the body 22 covers the marking agent (or containers containing the marking agent) at the inner and outer surfaces of the ring airfoil style paintball 20, thus generally containing the marking agent from radial release.

In addition, the marking agent is located at the very front of the body 22 at the nose portion 26, so that when the body 22 impacts a target, the marking agent is released into direct contact with the target. As described below, the marking agent is thus then positioned between the target and the body 22 at impact.

The paintballs of the invention may be constructed in a variety of fashions. For example, the body of the ring airfoil style paintball might be formed with compartments having a variety of other shapes, such as one which extend somewhat longitudinally from the nose towards the tail section.

In one embodiment, the ring airfoil style paintball is preferably configured (such as by considering the location of the marking agent) so that the center of gravity and center of pressure are substantially coincident. This contributes to neutral stability of the ring airfoil style paintball during flight and thus longer, more accurate flight.

In a preferred embodiment, the ring airfoil style paintball has a diameter of about 0.5-0.75 inches and a total weight of about 6-8 grams.

The ring airfoil style paintball of the invention has a number of advantages. Current spherical paintballs have a diameter of about 0.68 inches, a weight of about 3 grams and are fired at about 300 feet per second. The ring airfoil style paintball having the above-referenced weight and size, when fired with the same energy as a standard spherical paintball, will have a velocity of only about 200 feet per second. At this velocity, the ring airfoil style paintball has a range in excess of 30 meters, easily outranging current spherical paintballs. Notably, this firing velocity is some 33% less than that for the standard spherical paintball, dramatically reducing the probability of injury resulting from impact of the projectile, even at very close ranges.

Preferably, the ring airfoil style paintball is launched with both a forward velocity, but a stabilizing spin. A launcher and a method of launching the ring airfoil style paintball in accordance with the invention is described in detail below. Preferably, the ring airfoil style paintball is launched with a spin of about 4000 rpm, as such contributes to stabilization in flight.

In accordance with the invention, the ring airfoil style paintball has a both straight and level flight. Notably, at maximum range, the standard spherical projectile must be launched so that it travels along a parabolic path, substantially reducing the accuracy thereof. On the other hand, at ranges far exceeding the spherical paintball, the ring airfoil style paintball travels flat and true due to its aerodynamic characteristics. This increases the probability of a target being hit from afar, as compared to standard spherical paintballs.

Not only does the reduced velocity of the ring airfoil style paintball reduce the probability of injury, but so does its shape. As indicated, the ring airfoil style paintball has a greater impact surface area than a standard spherical paintball, thus spreading impact energy over a wider area, reducing impact force at a particular area. The larger size and less concentrated impact force substantially lessens the risk of injury to the eye and other small and sensitive body areas.

Figure 9:
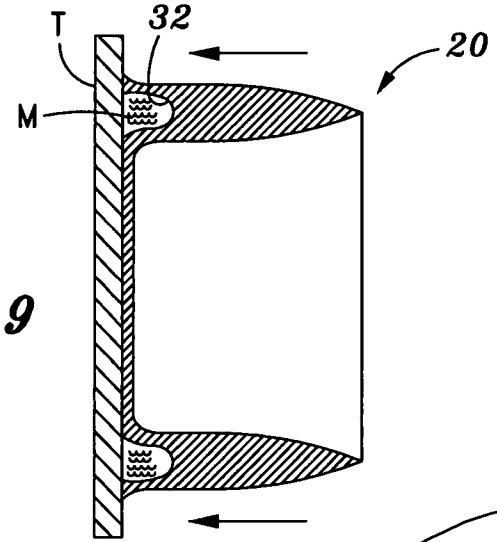
FIG. 9 illustrates a ring airfoil style paintball such as that illustrated in FIGS. 2 and 4 impacting and marking a target.

The marking process, which will be appreciated from the design of the ring airfoil style paintball, will not be described with reference to FIGS. 9-11. FIG. 9 illustrates a ring airfoil style paintball 20 such as that illustrated in FIGS. 1-4 impacting a target T. As illustrated, when the body 22 impacts the target T, the body 22 deforms and the compartment(s) 32 are ruptured or opened. Because the compartments 32 are located at the nose of the body 22, which is the portion of the body which impacts the target T, rupture of the compartments 32 causes marking agent M to be directly released into contact with the target T. Notably, marking or "imprinting" is effected not only because marking agent M is released into contact with the target T, but because the inertia of the body 22 causes the body 22 to press upon the marking agent M, forcing it into contact with the target T. In this manner, as illustrated in FIG. 11, after the ring airfoil style paintball 20 falls away from the target T, marking agent M is imprinted on or in the target T.

Figure 10:
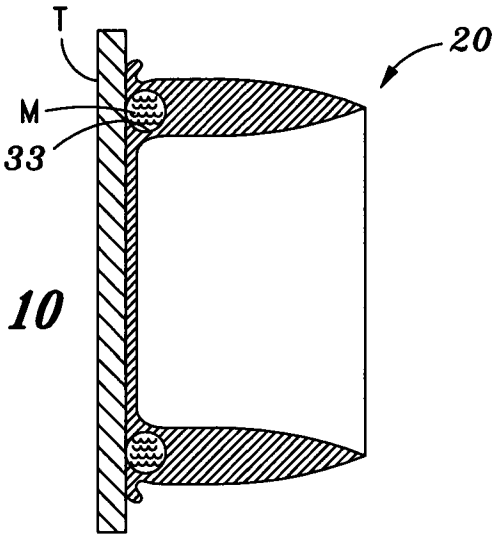
FIG. 10 illustrates a ring airfoil style paintball such as that illustrated in FIGS. 5 and 6 impacting and marking a target.
Figure 11:
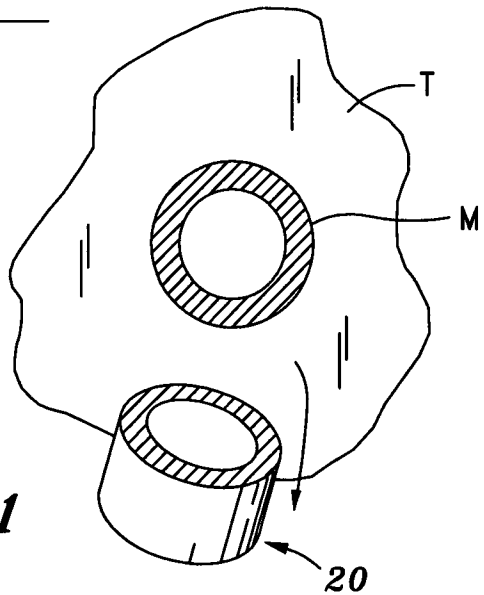
FIG. 11 illustrates a ring airfoil style paintball falling away from a target after the target has been marked.

FIG. 10 illustrates a ring airfoil style paintball 20 such as that illustrated in FIGS. 5 and 6 impacting a target T. As illustrated, when the body 22 impacts the target T, the body ruptures, thus releasing the one or more containers 33 into contact with the target T. These containers 33 are themselves ruptured, thus releasing marking agent M into contact with the target. Again, marking or imprinting is effected not only because the marking agent M is released into contact with the target T, but because the body 22 presses the containers 33 into contact with the target T, forcing the marking agent M into contact with the target T. Thus, as again illustrated in FIG. 11, after the ring airfoil style paintball 20 falls away from the target T, marking agent M is imprinted on or in the target T.

The ring airfoil style paintball of the invention may be launched in a variety of ways with a variety of mechanisms. One preferred launcher and method of launching will be described with reference to FIGS. 7-11.

Figure 8:
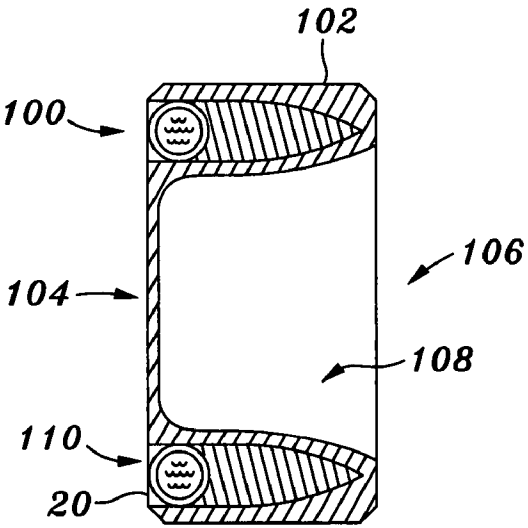
FIG. 8 is a cross-sectional side view of a ring airfoil-style paintball of the invention located in a sabot for use in launching the ring airfoil style paintball.
Figure 7:
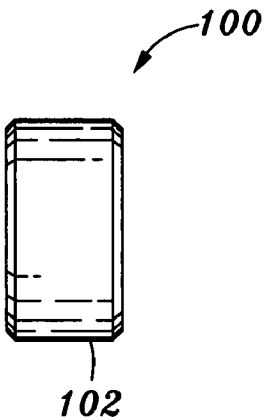
FIG. 7 is a side view of a sabot for use in launching a ring airfoil style paintball in accordance with the invention.

Referring to FIGS. 7 and 8, the ring airfoil style paintball 20 is preferably launched using a sabot 100. The sabot 100 essentially comprises a launch container or vehicle for the paintball 20.

The sabot 100 has a body 102. As illustrated in FIG. 7, the body 102 has a generally cylindrical outer shape for launching through the barrel of a launcher. The body 102 may be constructed of a variety of materials which are durable and strong, such as plastic.

Referring to FIG. 8, a chamber 108 is defined by the body 102 extending inwardly from a second end 106 thereof. Another chamber 110 is defined by the body 102 extending inwardly from a first end 104 thereof. The chamber 110 at the second end 106 preferably accepts a charge, such as a released compressed gas charged used to launch the sabot 100 from a launcher.

The chamber 110 at the first end 104 is preferably shaped to accept the ring airfoil style paintball 20 therein. As illustrated, the chamber 100 is configured so that the nose of the paintball 20 is located at the first end 104 of the sabot 100. The combination of the sabot 100 and ring airfoil style paintball 20 may be referred to as a "cartridge."

As described in more detail below, the sabot 100 containing the paintball 20 is launched from a launcher. The sabot 100 transfers energy, such as from a propellant gas, to the paintball 20. After launching, the sabot 100 is separated from the ring airfoil style paintball.

The sabot 100 is configured to protect the ring airfoil style paintball 20 during launch. Among other things, in one embodiment, a barrel of a launcher is preferably provided with rifling which causes the sabot to spin as a result of its traveling through the barrel during launch. In addition, the sabot 100 protects the ring airfoil style paintball 20 from damage resulting from release of the firing gas charge.

In order to satisfy its objectives, the sabot 100 is preferably designed to have stiff sides and broad bearing surfaces at both the area of the chamber 108 at the second end 106 and as engaging the paintball 20.

Figure 13:
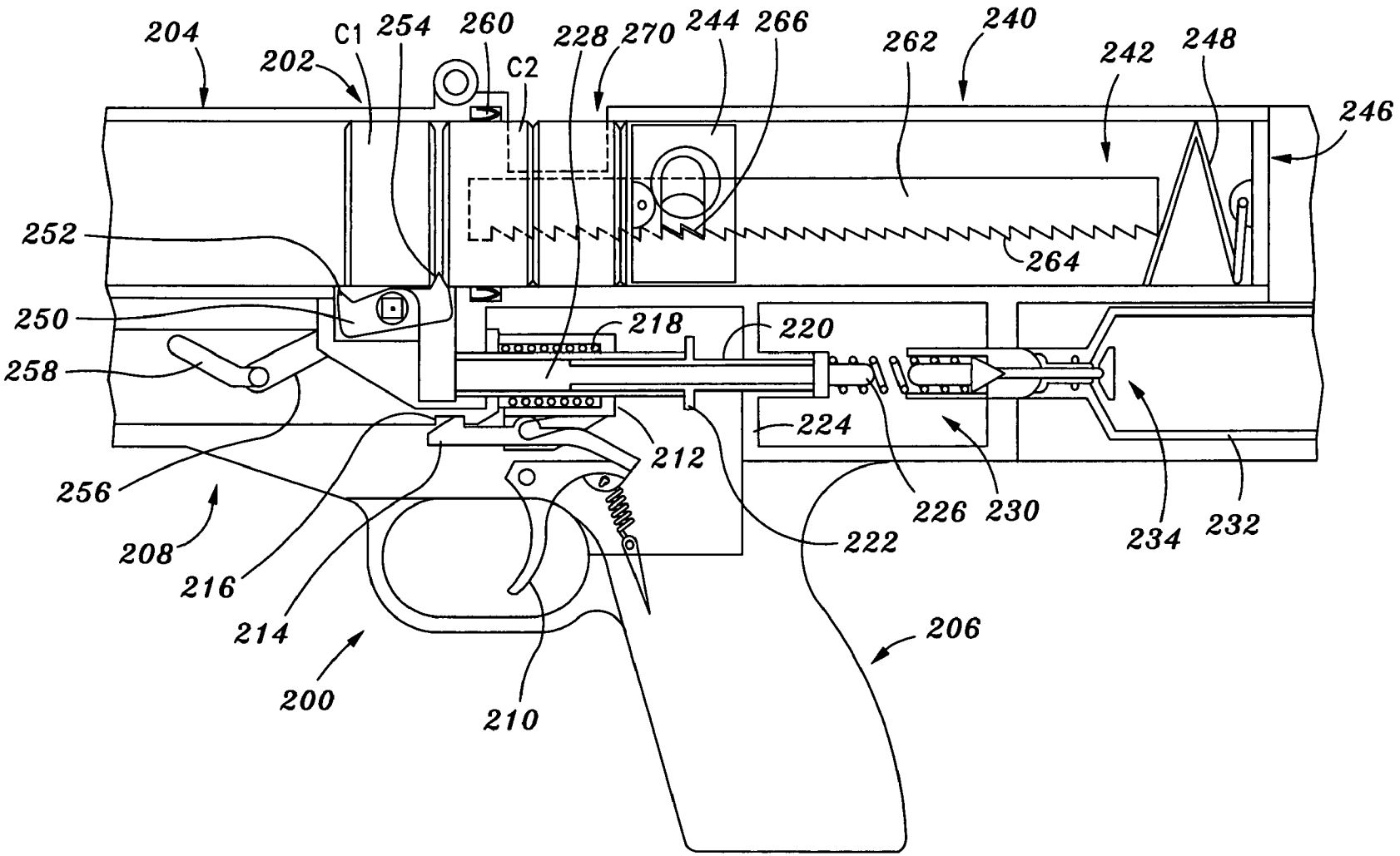
FIG. 13 is a cross-sectional side view of a ring airfoil style paintball launcher in accordance with an embodiment of the invention.
Figure 15:
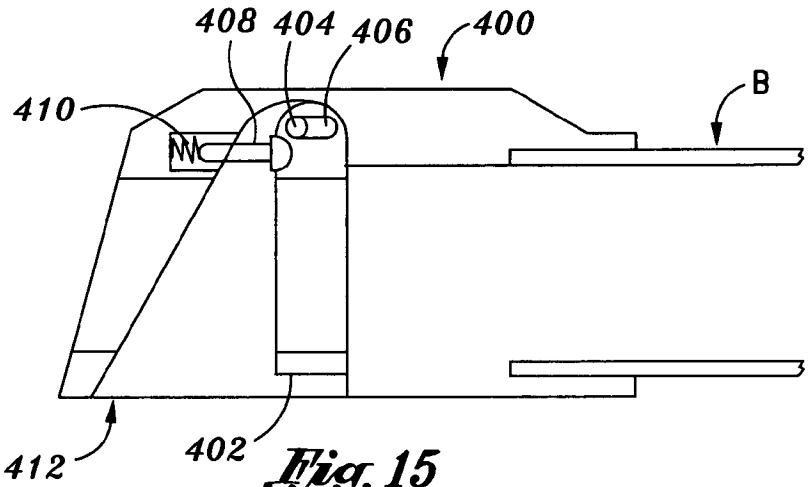
FIG. 15 illustrates another embodiment sabot stripper and ejector.

The ring airfoil style paintball of the invention may be launched in a variety of manners. One embodiment of a launcher 200 will now be described with reference to FIG. 13.

In accordance with this embodiment, the launcher 200 comprises a main body 202 defining a barrel 204, a handle 206 and a pump slide 208. The body 202 is configured to support and contain various elements of the launcher 200. The handle 206 extends from the body 202 for gripping by a user. As illustrated, a trigger 210 is positioned near the handle 206 for operation by the user when gripping the handle.

The barrel 204 comprises a portion of the body 202 which defines a passage through which projectiles are launched. Preferably, the projectiles are cartridges comprising a ring airfoil style paintballs housed within a sabot, as described above. The pump slide 208 is, as described in more detail below, utilized to place the launcher in condition for activation.

The trigger 210 can be moved between a first and second position. A illustrated, this movement is permitted through a standard pivot mounting of the trigger. When so moved, the trigger 210 actuates a hammer 212. In particular, when so moved, a portion of the trigger 210 releases a pivoting hammer-sear 214 from a detent 216 in the pump slide 208. Upon release, a spring 218 or other mechanism moves the hammer 212 and connected hammer-sear 214 rearwardly. As the hammer 212 moves rearwardly, it moves a valve body 220. Maximum travel of the valve body 220 may be limited by an outwardly extending stop 222 which engages a wall 224 or other limiting member.

As the valve body 220 moves rearwardly, it moves an associated valve head 226. When the valve head 226 moves rearwardly, it opens a passage 228 leading from an intermediate chamber 230 within the body 202 leading to the barrel 204.

In a preferred embodiment, launching force is provided with compressed gas. This gas has a source, such as a from a replaceable container 232 containing compressed air. In one embodiment, the container 232 has an associated regulator for releasing the compress gas. When appropriately connected to the launcher 200, gas is released into the intermediate chamber 230. Gas under pressure or an "air charge" is released from the intermediate chamber 230 to the barrel 204 when the valve head 226 is opened, in the manner just described. The launching process is further described below.

Preferably, the launcher 200 is configured for use in launching a plurality of projectiles. As such, the launcher 200 can preferably be reset after launching a first projectile into a position for launching a subsequent projectile.

After a first projectile is launched, the user resets the pump-slide 208 into engagement with the hammer-sear 214 by moving the pump-slide 208 rearwardly. This is accomplished by gripping an pulling rearwardly on the slide or an associated grip (not shown, but common the art of pump-action shotguns and the like, which grip generally extends from the underside of the body or barrel). The pump-slide 208 is then moved forward, pulling the hammer 212 forward with it, thereby compressing the spring 218 and readying the hammer 212 for release once again. In addition, a compressed air charge refills the intermediate chamber 230 from the bottle 232 or other source, preparing a charge for release once the valve head 226 is again reopened.

As described, the launcher 200 is preferable useful in launching one or more cartridges C comprising a sabot containing ring airfoil style paintball. In use, as described above, a compressed air charge is directed through the passage 228. This charged to directed to a point behind a loaded cartridge C. When this occurs, the compressed air forces the cartridge C forward through the barrel 204 and launches it from the launcher 200. As described below, in this process the sabot is preferably stripped from the ring airfoil style paintball.

In the preferred embodiment, multiple cartridges C may be associated with a magazine 240 for feeding to the launcher 200 in sequential fashion. The magazine 240 is preferably connectable to the launcher 200.

As illustrated, the magazine 240 comprises a body 242 defining a projectile containing area 242. In one embodiment, the projectile containing area 242 is generally cylindrical in shape.

Preferably, the cartridges C are located in front of a follower 244. The follower 244 is biased forward from a rear end 246 thereof, such as with a helical spring 248 which extends between the rear end 246 of the magazine 240 and the follower 244 (the entire spring is not illustrated in FIG. 13 so as not to obscure other portions of the launcher).

Preferably, means are provided for controlling the transport and delivery of cartridges C from the magazine 240 to the barrel 204. As illustrated, the launcher 200 includes an escapement 250. The escapement 250 is preferably configured to control the loading of a cartridge C from the magazine 240 into the barrel 204. In one embodiment, the escapement 250 is pivotally mounted and configured to, in one position, engage the front of a cartridge C to limit its travel forward into the barrel 204, and in another position, engage and separate the front-most loaded cartridge C from those located therebehind in the direction of the magazine 240 during the launch process.

In the first position, a forward portion 252 of the escapement 250 engages a cartridge C, limiting its forward movement into the barrel 204. In this position, the front portion 252 of the escapement 250 is raised upwardly and a rear portion 254 is lowered, permitting the magazine spring 248 to move the cartridges C forward until they are stopped. This position of the escapement 250 is preferably associated with movement of the pump slide 208 rearwardly, which in turn effects movement of an associated arm 256 in a slot 258. The position of the arm 256 changes as the pump slide 208 is moved rearwardly, in turn moving the escapement 250 into this position.

When the pump slide 208 is moved forward, the arm 256 is moved, causing the escapement 250 to move to the position illustrated in FIG. 7 in which its rear portion 254 is located between the frontmost C1 and next cartridge C2. In this position, forward motion of the cartridges C behind the front cartridge C1 is limited or stopped. On the other hand, the frontmost cartridge C1 may be launched through the barrel 204 (the front portion of the escapement not blocking or engaging the front of the frontmost cartridge C1) as described above.

In the configuration illustrated, the second cartridge C2 serves the function of closing and obturating the rear of the barrel or breach during launch. As illustrated, this cartridge C2 cooperates with a seal 260, such as a flexible ring seal, which allows forward cartridge movement but which sufficiently grips the cartridge C2 to prevent gas by-pass. Other means or mechanisms may satisfy this function other than by use of the cartridge and seal.

Preferably, the stack or line of cartridges including the second cartridge C2 and those behind in the magazine 240 are supported against movement upon launch, including the pressurized gas and recoil force the gas presents. In one embodiment, a ratchet is provided for this purpose. As illustrated, the magazine follower 244 is attached to a ratchet 262.

In one embodiment, the ratchet 262 comprises a handle (not shown) which extends from the follower 244, and a ratchet body 262 which is connected to the handle. As illustrated, the ratchet body 262 is an elongate element having a plurality of teeth 264 formed therein. The ratchet 262 is arranged so that the teeth 264 engage corresponding teeth 266 formed in the magazine 240 or an element connected thereto. These elements are positioned so that they do not interfere with the location of the cartridges C in the magazine 240.

The ratchet 262 is biased into a position in which its teeth 264 engage the teeth 266 associated with the magazine 240. Preferably, this is accomplished with the magazine spring 248. In a preferred embodiment, the spring 248 has is fixedly mounted to the magazine 246 at one end and the follower 244 at the other. The spring 248 is wound or twisted so that it biases the follower 244 in the clockwise direction (when looking from the magazine towards the barrel) so that the ratchet 262 is pressed downwardly.

In operation, the spring 248 biases the teeth 264 of the ratchet 262 into engagement with the teeth 266 of the magazine 240. Preferably, the inter-engaging teeth are oriented to prevent rearward relative movement (as illustrated, by the direction the teeth face), thus preventing rearward movement of the cartridges C in the magazine 240 upon launch. However, the teeth are configured to permit forward movement of the ratchet 262 and associated follower 244, thus allowing the spring 248 to move the follower 244, and thus the associated cartridges C, forward during the loading process described above.

In a preferred embodiment, the handle extends outwardly of the magazine 240 and is useful in loading cartridges C into the magazine 240. In particular, the operator may lift the handle upwardly to release the ratchet 262. The operator may then pull the handle and connected follower 244 rearwardly. When released, the ratchet 262 rotates back to a locked position. With the follower 244 retracted towards the rear 246 of the magazine 240, the operator may load cartridges C into the magazine 240 through a load opening 270 formed in the magazine 240 at its forward end. Similarly, this action and opening 270 may be used by the operator to remove cartridges C from the magazine 240, if necessary.

It will be appreciated that launchers having other configurations than just described may be utilized to launch the ring airfoil style paintballs. For example, though not as desirable, the launcher could be a single shot variety in which the user must load each cartridge into the breach by hand. Other firing forces may be utilized than compressed gas from a container. For example, the gas could be generated from a fired charge or be provided from a remote source. The launcher may also be designed so to eliminate the "pump action" resetting of the launcher. For example, the launcher may be configured so that the hammer is reset automatically.

It will also be appreciated to one of ordinary skill in the art that the launcher may be constructed in a variety of manners, including from a variety of materials. Various of the components of the launcher may be formed separately and then be connected or assembled. Alternatively, the components described may actually be formed integrally.

As described, the ring airfoil style paintball of the invention is preferably launched using a sabot, preferably with a launcher such as that described above. As described, when the launcher is used to launch the sabot containing ring airfoil style paintball, the ring airfoil style paintball must be separated from the sabot. Preferably, this occurs at the launcher. Once the sabot has been separated from the ring airfoil style paintball, the sabot is preferably ejected from the launcher so that other ring airfoil paintballs may be launched using the launcher.

The launcher of the invention has a number of advantages. First, though the launcher is configured to launch ring airfoil projectiles, the launcher may utilize the same compressed air cartridges as launchers for traditional spherical paintballs. The magazine configuration permits a plurality of cartridges to be launched in sequence. The magazine provides for linear, rather than lateral, loading movement, simplifying the magazine, cartridge movement and loading, and increasing reliability.

FIGS. 14-17 illustrate various embodiments of sabot stripper and ejector mechanisms for use with the cartridge of the invention. Each of these figures illustrates a stripper and ejector mechanism for location at the distal end of a barrel B of a launcher. The barrel B may be, for example, the barrel 204 of the launcher 200 just described and illustrated in FIG. 13.

Figure 14:
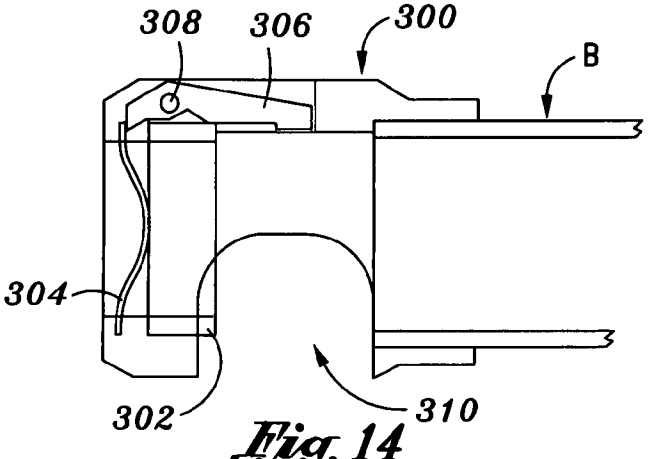
FIG. 14 illustrates one embodiment of a sabot stripper and ejector for a ring airfoil style paintball launched from a launcher.
Figure 16:
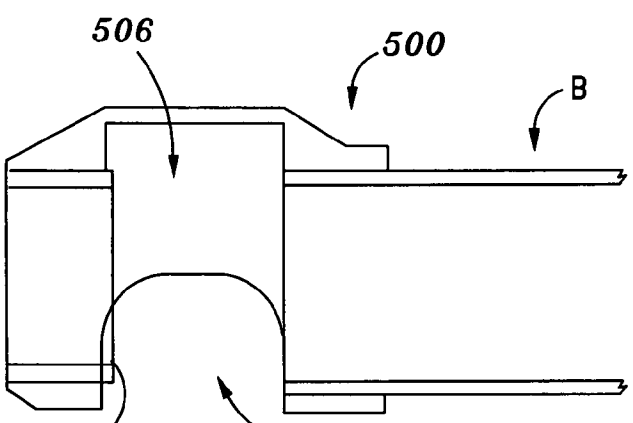
FIG. 16 illustrates another embodiment sabot stripper and ejector.

Referring to FIG. 14, a body 300 is located at the end of the barrel B. The body 300 defines a passage aligned with the passage through the barrel B. The body 300 defines or holds a stop ring 302. The stop ring 302 is configured to engage and stop a sabot of a cartridge, and yet defines a central passage through which a ring airfoil style paintball may pass.

The stop ring 302 is permitted to travel linearly within the body 302 a short distance such as along a constrained track formed in the body, to engage an actuating member. In one embodiment, the actuating member is a wave spring 304. The wave spring 304, in turn, engages an ejector arm 306. When compressed, the wave spring 304 causes the ejector arm 306 to rotate about a pivot point 308 into the passage through the body 300.

In operation, a launched cartridge travels through the barrel B. Upon impacting the stop ring 302, the sabot is stopped and the ring airfoil style paintball continues to travel forward through the body 300, exiting the body towards the intended target. The impact of the sabot causes the stop ring 302 to travel forward and compress the wave spring 304. This causes the ejector arm 306 to rotate to a position where it engages the sabot. The arm presses the sabot downwardly through an lower opening 310 formed in the body 300. The sabot is pressed out of the body 300, clearing the path for the next launched cartridge.

It will be appreciated that other variations of this approach my be utilized. For example, one or more coil springs or other biasing elements may be used to maintain the stop ring 302 in a rearward position. When the stop ring 302 moves forward, it may compress the one or more springs and directly engage a portion of the ejector arm 306 or another member which engages the arm, thereby effecting movement of the arm.

In another embodiment illustrated in FIG. 15, a body 400 is again associated with the barrel B and defines a passage there through. A stop ring 402 is again mounted for movement relative to the body 400. As illustrated, the stop ring 402 is mounted to a pivot pin 404 which engages a generally horizontal slot 406 in the stop ring 402. The stop ring 402 is biased to a position in which the pivot pin 404 engages a front of the slot 406. As illustrated, this is accomplished with a plunger 408 which presses the stop ring 402 in the direction of the barrel B under the force of a spring 410.

In operation, when the cartridge impacts the stop ring 402, the sabot is stopped and the ring airfoil passes through the stop ring 402 and the remainder of the body 400, where it exits the body. The impact of the sabot into the stop ring 402 first causes the stop ring 402 to move forward linearly (thus ensuring that the ring airfoil passes there through when the sabot is stripped away). When the pin 404 reaches the rear end of the slot 406, the stop ring 402 begins to rotate upwardly, placing it into a canted position. This allows the sabot therebehind to fall through a lower opening 412 formed in the body 400, clearing the path for the next launched cartridge.

In another embodiment in FIG. 16, a body 500 is again associated with the barrel B and defines a passage. A stop ring 502 is again associated with the body 500. As illustrated, the stop ring 502 is located distal to an ejector opening 504 in the body 500 and an associated gas accumulation chamber 506 defined by the body 500.

In operation, the sabot of a launched cartridge is stopped by the stop ring 502. The associated ring airfoil style paintball is permitted to travel through the stop ring 502 and exit the body 500. Once the sabot has been stopped, muzzle gas which was originally behind the sabot is permitted to flow into and accumulate in the accumulation chamber 506 above the sabot. The pressure of the accumulated gas forces the sabot downwardly through the opening 504, clearing the path for the next launched cartridge.

Figure 17:
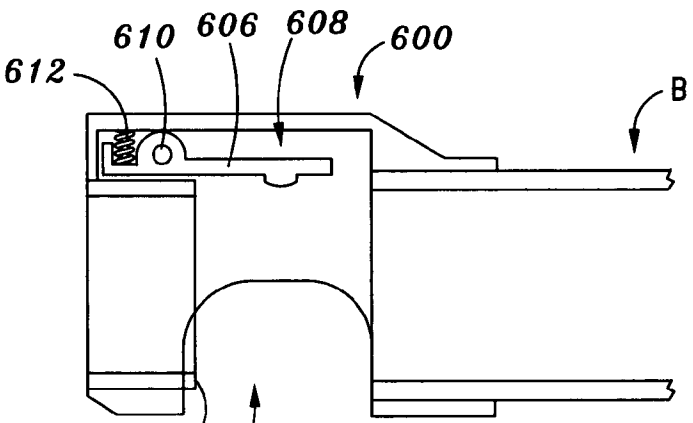
FIG. 17 illustrates yet another embodiment sabot stripper and ejector.

In yet another embodiment illustrated in FIG. 17, a body 600 is once again associated with the barrel B and defines a passage. A stop ring 602 is associated with the body 600 and is located distal of an ejector opening 604 in the body 600.

An ejector arm 606 is located in an accumulation chamber 608 formed above the opening 604. The ejector arm 606 is pivotally or otherwise movably mounted, such as about a pin 610, which a portion of the arm 606 having a greater surface area located in the chamber 606. The arm 606 is biased into an upward position, as illustrated, such as with a spring 612.

In operation, the sabot of a launched cartridge is stopped by the stop ring 602. The associated ring airfoil style paintball is permitted to travel through the stop ring 602 and exit the body 600. Once the sabot has been stopped, muzzle gas which was originally behind the sabot is permitted to flow into and accumulate in the accumulation chamber 608 above the sabot. The pressure of the accumulated gas forces the ejector arm 606 to rotate downwardly towards the opening 604 (against the force of the spring 612). The arm 606 engages and ejects the sabot downwardly through the opening 604, clearing the path for the next launched cartridge. Upon ejection and release of the gas pressure, the spring 612 returns the ejector arm 606 back to the position illustrated in which it does not extend into the passage through which the sabot and ring airfoil style paintball travel.

As indicated above, a variety of other embodiments of sabot stripper and ejector mechanisms are desired. FIGS. 14-17 illustrate variations in which the stripping and ejecting actions are accomplished automatically (i.e. without user intervention), such as by utilizing force imparted upon the sabot, gas charges or the like. Of course, other mechanisms may be provided, including those which require the user to eject the sabot. For example, once a sabot has been stripped with a stop ring, the user might actuate an ejector lever which engages the sabot and presses it from the launcher.

Of course, the stripper and ejector bodies as described above maybe connected to or formed with the barrel of the launcher. The particular elements of the stripper and ejector mechanisms may vary. For example, while the stop ring has been described in one embodiment as generally annular, the stop ring need not be "ring" shaped. For example, it may comprise one or more outwardly extending tabs, arcuate stop sections or the like.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of marking a target with a marking agent comprising:

providing a ring airfoil comprising a generally annular ring airfoil body surrounding a central passage, said body having a nose and a tail generally opposite said nose, said body defining at least one cavity located within said body, said at least one cavity containing said at least one container containing marking agent;

launching said ring airfoil at a target;

impacting said target with said ring airfoil;

rupturing solely said body at said nose portion, whereby said cavity within said nose portion is opened;

rupturing said at least one container;

releasing marking agent from said at least one ruptured container into direct contact with said target, and marking said target in an area of said target corresponding to where said airfoil impacted said target.

2. The method in accordance with claim 1 including the step of rupturing said nose portion of said body at one or more stress risers located in said nose portion.

3. A method of marking a target with a marking agent comprising:

providing a projectile for delivering a payload of marking agent comprising a ring airfoil comprising a generally annular ring airfoil body surrounding a central passage, said body having a nose portion and a tail portion generally opposite said nose portion, said nose portion defining at least one internal cavity enclosed by said body, which cavity contains at least one container containing marking agent;

launching said projectile towards a target;

impacting said nose of said body of said projectile into contact with said target;

rupturing a material forming said nose of said body of said projectile, thereby opening said cavity and exposing said one or more containers containing marking agent to said target;

rupturing said one or more containers containing marking agent;

releasing said marking agent from said one or more containers;

transferring an inertial force of said generally solid tail portion of said body to said marking agent; and imprinting said target with said marking agent in an area of said target corresponding to where said nose of said body impacted said target.

4. The method in accordance with claim 3 wherein said at least one container is annular in shape.

5. The method in accordance with claim 3 wherein said at least one container comprises a plurality of spherical containers spaced around said cavity.

6. The method in accordance with claim 3 wherein a forward-most portion of said cavity is defined by a thin wall of said nose.

7. The projectile in accordance with claim 3 wherein said thin wall includes a plurality of stress risers for causing said thin wall to rupture upon said projectile impacting a target.

* * * * *